United States Patent [19]

Grubbs et al.

[11] Patent Number: 4,958,435

[45] Date of Patent: Sep. 25, 1990

[54] RIPPING SCISSORS

[75] Inventors: Jeffrey W. Grubbs; David S. Chapin, both of Raleigh, N.C.

[73] Assignee: Cooper Industries, Inc., Houston, Tex.

[21] Appl. No.: 282,236

[22] Filed: Dec. 9, 1988

[51] Int. Cl.[5] ..... B26B 13/00

[52] U.S. Cl. ..... 30/248; 30/234; 30/244

[58] Field of Search ..... 30/248, 234, 235, 244, 30/252, 254, 257

[56] References Cited

U.S. PATENT DOCUMENTS

| | | | |
|---|---|---|---|
| 2,662,285 | 12/1953 | Yeomans | 30/248 |
| 3,438,130 | 4/1969 | Ballard et al. | 30/248 |
| 3,624,900 | 12/1971 | Bosley | 30/234 |
| 4,507,864 | 4/1985 | Leibowitz | 30/257 |

*Primary Examiner*—Douglas D. Watts
*Assistant Examiner*—Willmon Fridie, Jr.
*Attorney, Agent, or Firm*—David A. Rose; Ned L. Conley

[57] ABSTRACT

A device for ripping fabric includes two blades which act together in a scissor like fashion. A handle is rigidly attached to one of the blades. The movement of the handle back and forth causes a scissor like action between the blades. After the cut has been started, the device may be pushed through the fabric.

17 Claims, 1 Drawing Sheet

RIPPING SCISSORS

BACKGROUND OF THE INVENTION

The present device pertains to scissors, more particularly the device of the present invention pertains to scissors having two blades and a handle affixed to one of the scissor blades.

Scissor type devices have been in use for many years. When is it desired to cut or rip a piece of fabric, the piece of fabric is normally laid on a flat surface and the cut is initiated by using the scissoring action of a pair of sharpened connected blades. In some fabrics, the scissoring action may be stopped once the cut is started and the scissors merely pushed through the fabric or the like to complete the cut. Herein, the scissor blades are used as a knife.

If a pair of straight handled scissors is used to cut a large piece of fabric or the like, a portion of the hand, particularly the ends of the fingers, must be located under the piece of fabric. Such location of the fingers is inconvenient to the worker and oftentimes distorts the path of the cut. In addition, such straight handled scissors often require the user to bend his/her wrist at an awkward angle.

In response to these problems, several scissor designs have been proposed wherein the scissor handles have been bent to an obtuse angle with respect to the cutting blades. This bending of the handles with respect to the scissor blades still requires that the handles be moved one with respect to the other in order to provide a scissoring action between the sharpened blades. Such action is again difficult for the worker and oftentimes causes a distorted cut. In addition, such scissors are difficult to manufacture.

There is therefore a need in the art to provide a scissor type device which eliminates the requirement for manual movement of both blades, one with respect to the other, when ripping or making a long cut in a piece of fabric or the like. Additionally, such scissor type device should be simple to use and inexpensive to manufacture.

SUMMARY OF THE INVENTION

The convenient, easy-to-use and inexpensive to manufacture scissor type device of the present invention requires movement of only one blade when making a long cut in a piece of fabric. The scissor type device includes a substantially horizontal lower stationary blade which passes under the piece of fabric. The substantially horizontal lower stationary blade includes a cutting edge and a pivot hole. Attached to the substantially horizontal lower moving blade at the pivot hole is an upper moving blade. The upper moving blade is further attached to a handle. The cutting action between the substantially horizontal stationary blade and the upper moving blade is created by moving the handle-back and forth as the device is moved through the fabric. To return the scissor blades to their open position, the substantially horizontal stationary blade is spring biased open with respect to the moving blade. The spring bias may be located at the pivot point between the two blades or located in the handle. If the spring bias is located within the handle, it acts against an extension arm extending into the handle from the substantially horizontal fixed blade. The handle is positioned so that it is at an acute angle with respect to the blades. Operation of the device in its scissoring mode is accomplished by rotating the handle with respect to the pivot point between the blades. While the substantially horizontal lower fixed blade is pressed against the cutting surface. The new scissors of the present invention provide an alternative wrist position that can, in many cases, be more comfortable.

BRIEF DESCRIPTION OF THE DRAWINGS

A better understanding of the scissor type device of the present invention may be had by reference to the drawings wherein.

BRIEF DESCRIPTION OF THE EMBODIMENTS

Figure 1:
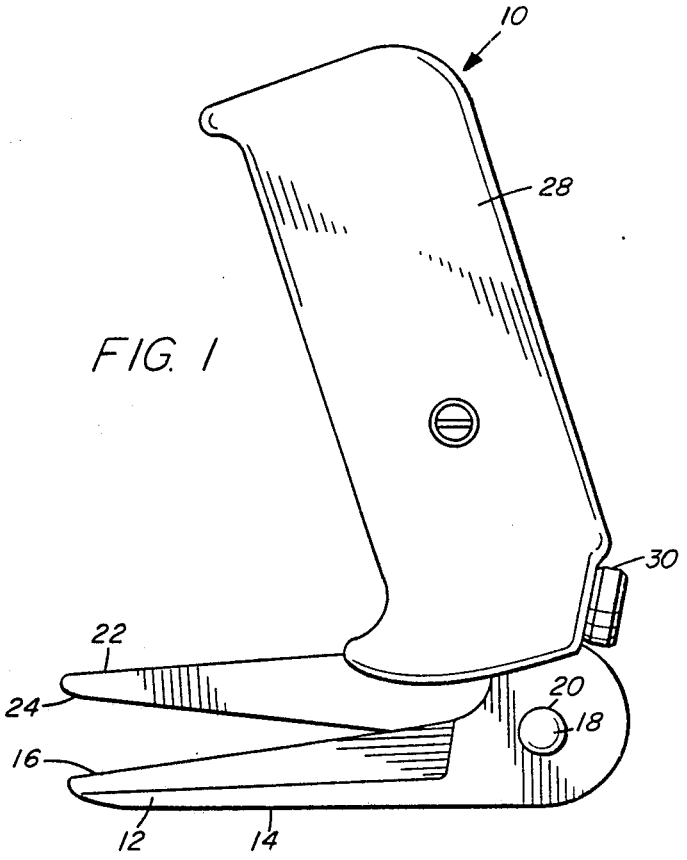
FIG. 1 is a side elevational view of the preferred embodiment of the scissor type device for cutting fabric or the like of the present invention.
Figure 2:
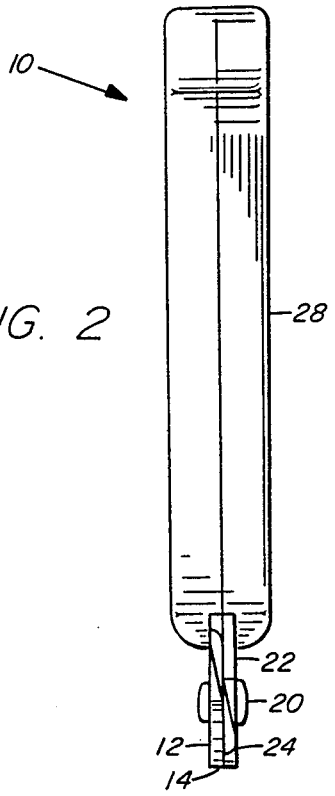
FIG. 2 is a left side view of the device shown in FIG. 1.
Figure 3:
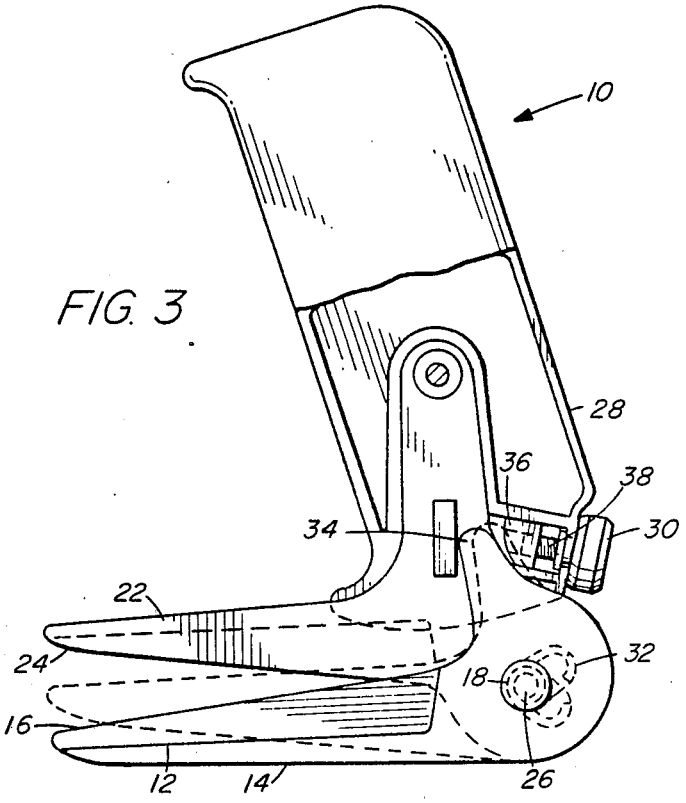
FIG. 3 is a view of similar to FIG. 1 with a portion of the handle removed and showing the inter-relationship of the blades when closed.

The preferred embodiment of device 10 for cutting fabric or the like of the present invention is shown in FIGS. 1, 2 and 3. Therein it may be seen that device 10 includes three essential components. The first component is a substantially horizontal fixed blade 12 which, in operation, rides under a piece of fabric (not shown). This blade 12 may have a flat bottom edge 14 or a separate piece attached to the bottom edge to assist in gliding the blade over the cutting surface which passes along the surface on which the piece of fabric or the like is placed. Blade 12 also has a sharpened top edge 16 and a pivot hole 18.

A fastener 20, attaches substantially horizontal fixed blade 12 to moving blade 22. Moving blade 22 similarly has sharpened edge 24 and pivot hole 26 for receiving threaded fastener 20. Fixed blade 12 is rigidly attached to the third essential component which is handle 28. Shown also in FIGS. 1 and 3 is adjustment knob 30 which is located just above the pivot holes 18 and 26. While not essential for operation of the invention, knob 30 is included in the preferred embodiment.

Details with regard to the construction of the preferred embodiment may be seen by reference to FIG. 3. Therein it may be seen that spring bias 32 is attached around the pivot holes 18 and 26 of blades 12 and 22. Spring bias 32 urges substantially horizontal fixed blade 12 to an open position with respect to moving blade 22. It may also be seen in FIG. 3 that substantially horizontal moving blade 12 includes arm 34 which extends into handle 28. Pushing against arm 34 is threaded fastener 36. Passing through threaded fastener 36 is threaded rod 38 which is attached to adjustment knob 30. By turning adjustment knob 30, threaded fastener 36 pushes against extension arm 34 to set the maximum closed position of substantially horizontal fixed blade 12 with respect to moving blade 22. The adjustment screw 30 acts to keep the blades in a slightly open position, even when the blades are maximally closed as shown in phantom in FIG. 3. This aids in using the shears as a ripping tool because the blades are always open slightly, so that the shears may be pushed through the fabric. While the adjustment system is as shown in the preferred embodiment of FIG. 2 it will be understood that such adjustment system is an optional construction and need not be included.

OPERATION

The following description of the operation of the scissor type cutting device applies to all three embodiments. For illustrative purposes the description of operation will only reference the preferred embodiment.

When it is desired to cut a piece of fabric or the like, substantially horizontal fixed blade 12 is placed under the piece of fabric. The user then grasps handle 28 and pivots it back and forth, by pushing against the handle, thereby forcing the lower blade against the cutting surface. This movement causes moving blade 22 to move up and down with respect to substantially horizontal fixed blade 12.

For ease of use, it has been found that the formation of an acute angle between blades 12 and 22 and handle 28 provides the best and most convenient means of operating device 10. By increasing and decreasing this acute angle between blades 12 and 22 a cut is made. In some fabrics the scissoring action may be stopped once the cut is started and device 10 may be pushed through the fabric like a knife to complete the cut. This is the primary use for such a device. There is now provided by device 10 for cutting fabric of the present invention an easy-to-use, simple to manufacture device for cutting fabric which may be used to either make a cut in fabric by the scissoring action of two blades or rip the fabric by directly pushing the device through the fabric. Both operations are accomplished by the manipulation of only one blade. In addition, the operator's hand is kept completely above the place of the fabric.

The scissor type device of the present invention now having been described with reference to its embodiments will provide those of ordinary skill in the art a sufficient teaching for the construction of other embodiments. Such other embodiments shall fall within the scope of the appended claims.

What is claimed is:

1. A device for cutting fabric or the like comprising:
- a substantially horizontal fixed blade having a cutting edge and a pivot hole;
- a moving blade having a cutting edge and a pivot hole;
- a handle rigidly affixed to said moving blade to form an acute angle therewith;
- means for attaching said substantially horizontal fixed blade to said moving blade at said pivot holes;
- means for biasing said substantially horizontal fixed blade to an open position with respect to said moving blade; and
- means to prevent pivoting of the moving blade and the horizontal fixed blade towards each other to a point past a certain adjustable limit.

2. The device as defined in claim 1 further including an extension arm wherein said adjustable limit is adjusted by moving a threaded bolt against the extension arm.

3. The device as defined in claim 2 wherein said means for biasing said substantially horizontal fixed blade to an open position with respect to said moving blade includes a spring located at said pivot point.

4. The device as defined in claim 2 wherein said means for biasing said substantially horizontal moving blade to an open position with respect to said fixed blade includes a spring located at said pivot point.

5. The device as defined in claim 1 wherein said substantially horizontal moving blade includes an extension arm extending into said handle and said means for biasing said substantially horizontal moving blade to an open position with respect to said fixed blade acts on said extension arm.

6. The device as defined in claim 1 wherein said blades are retractable into said handle.

7. The device as defined in claim 1 wherein said handle is angularly positionable with respect to said blades.

8. A system for ripping fabric or the like comprising:
- a substantially horizontal fixed blade constructed and arranged to pass under a piece of fabric or the like;
- said substantially horizontal fixed blade having an edge and a pivot hole;
- a moving blade constructed and arranged to pass over a piece of fabric or the like, said moving blade having an edge and a pivot hole;
- means for moving said moving blade into said substantially horizontal fixed blade, said means for moving being rigidly attached to said moving blade;
- means to connect said substantially horizontal fixed blade to said moving blade at their respective pivot holes;
- means to bias said substantially horizontal fixed blade to an open position with respect to said moving blade where the fabric or the like may be ripped by scissoring said substantially horizontal moving blade with respect to said moving blade and by pushing the device through the fabric or the like.

9. The device as defined in claim 8 further including means to prevent pivoting past a certain adjustable limit in the direction where the moving blade and the horizontal blade approach each other.

10. The device as defined in claim 9 further including an extension arm wherein said adjustable limit is adjusted by moving a threaded bolt against the extension arm.

11. The device as defined in claim 8 wherein said means for biasing said substantially horizontal fixed blade to an open position with respect to said moving blade includes a spring located at said pivot hole.

12. The device as defined in claim 9 wherein said means for biasing said substantially horizontal fixed blade to an open position with respect to said moving blade includes a spring located at said pivot hole.

13. The device as defined in claim 8 wherein said substantially horizontal fixed blade includes an extension arm extending into said handle and said means for biasing said substantially horizontal fixed blade to an open position with respect to said moving blade acts on said extension arm.

14. The device as defined in claim 8 wherein said blades are retractable into said handle.

15. The device as defined in claim 8 wherein said handle is angularly positionable with respect to said blades.

16. A device for cutting or ripping fabric or the like comprising:
- an upper blade and a lower blade pivotal with respect to each other about a horizontal axis located substantially at the end of each blade;
- the upper and lower blades each having a cutting edge portion located on a first side of the horizontal axis;
- means for biasing the upper and lower blades to a position where they are separated from each other;
- a handle affixed to the upper blade on the first side of the horizontal axis and extending at an acute angle with respect to the upper blade such that manipulation of the handle pivots the upper blade with respect to the lower blade.

17. The device of claim 16 further including means to prevent pivoting past a certain adjustable limit in the direction where the upper blade and the lower blade approach each other.

* * * * *

UNITED STATES PATENT AND TRADEMARK OFFICE

CERTIFICATE OF CORRECTION

PATENT NO. : 4,958,435

DATED : September 25, 1990

INVENTOR(S) : J. W. Grubbs, D. S. Chapin

It is certified that error appears in the above—identified patent and that said Letters Patent is hereby corrected as shown below:

Column 2, Line 2; after "blades" delete ". While" and insert --, while--.

Column 3, line 56; delete "2" and insert --1--.

Signed and Sealed this

Seventeenth Day of December, 1991

*Attest:*

HARRY F. MANBECK, JR.

*Attesting Officer*

*Commissioner of Patents and Trademarks*